US007615717B2

(12) United States Patent
Nakase et al.

(10) Patent No.: US 7,615,717 B2
(45) Date of Patent: Nov. 10, 2009

(54) SWITCH

(75) Inventors: Yusho Nakase, Yokohama (JP); Yong-Hui Hu, ShenZhen (CN); Tai-Ping Xiong, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/824,786

(22) Filed: Jul. 3, 2007

(65) Prior Publication Data

US 2008/0073195 A1 Mar. 27, 2008

(30) Foreign Application Priority Data

Jul. 3, 2006 (CN) ..... 200620074644.6

(51) Int. Cl.
*H01H 1/36* (2006.01)

(52) U.S. Cl. ..... 200/536; 200/547

(58) Field of Classification Search ..... 200/16 C, 200/18, 537, 550, 536, 547
See application file for complete search history.

(56) References Cited

U.S. PATENT DOCUMENTS 5,345,372 A * 9/1994 Takano et al. ..... 362/394
5,380,971 A * 1/1995 Bittel et al. ..... 200/536
5,824,977 A * 10/1998 Takano et al. ..... 200/16 C
5,969,309 A * 10/1999 Nishimura et al. ..... 200/16 C

* cited by examiner

*Primary Examiner*—Kyung Lee
(74) *Attorney, Agent, or Firm*—Ming Chieh Chang; Wei Te Chung; Andrew C. Cheng

(57) ABSTRACT

A switch (100) comprises a dielectric housing (1), a number of stationary contacts (2) disposed in the housing (1), a moveable contact (3) and a slide element (4) movably mounted in the housing (1), a spring (5) disposed in the housing (1), and a cover (6) attached to the housing (1). The housing (1) defines a bottom wall (11) and four side walls extending from the bottom wall (11), the bottom wall (11) of the housing (1) having a locating post (16) cooperating with a side wall of the housing (1) to confine the spring (5). The slide element (4) defines a slide groove (420) which receives the locating post (16) so as to guide the spring (5) in the housing (1) steadily.

5 Claims, 4 Drawing Sheets

SWITCH

BACKGROUND OF THE INVENTION

1. Field of the Invention

The present invention relates to a switch for use in various electronic devices such as digital cameras.

2. General Background

Nowdays, switches of the so-called auto return type are widely used in various electronic devices such as digital cameras. The conventional switch generally comprises a dielectric housing, a plurality of stationary contacts disposed in the housing, a moveable contact and a slide element movably mounted in the housing and defining an operating portion, a spring disposed in the housing, and a cover attached to the housing.

In use, the switch is mounted onto a printed circuit board, and the stationary contacts connect with corresponding circuits of the printed circuit board. At this time, the moveable contact contacts with some predetermined stationary contacts. When the operating portion of the slide element is actuated from the neutral position to the pressed position, the spring is compressed, and the moveable contact contacts with some other predetermined stationary contacts in the bottom surface of the housing. When the operating portion is released, the slide member will return to the neutral position under the force of the spring.

However, one problem with this conventional switch is that the spring is prone to be ejected from its position or even from the housing when the slide element is sharply pressed by the released spring to return to the neutral position. Therefore, reliable mechanical performance of the switch is not ensured.

In view of the above, a new switch which overcomes the above-mentioned disadvantages is desired.

SUMMARY

Accordingly, an object of the present invention is to provide a switch that can prevent the spring from being ejected from its predetermined position, thereby ensuring reliable mechanical performance of the switch.

According to a preferred embodiment of the invention, a switch in accordance with a preferred embodiment of the present invention comprises a dielectrical housing, a plurality of stationary contacts disposed in the housing, a moveable contact and a slide element movably mounted in the housing, a spring disposed in the housing, and a cover attached to the housing. The housing comprises a bottom wall and four side walls extending from the bottom wall. The bottom wall of the housing has a locating post cooperating with a side wall of the housing to confine the spring. The slide member defines a slide groove which receives the locating post and the width of the slide groove is smaller than the diameter of the spring. When the slide member and the spring slide towards a side wall of the housing, the locating post is placed in the slide groove of the slide member to control the path of the slide member. When the slide member auto returns to neutral position, the spring will stop in the position of contacting the locating post. Therefore, the spring will not be ejected from the housing and reliable mechanical performance of the switch is achieved.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
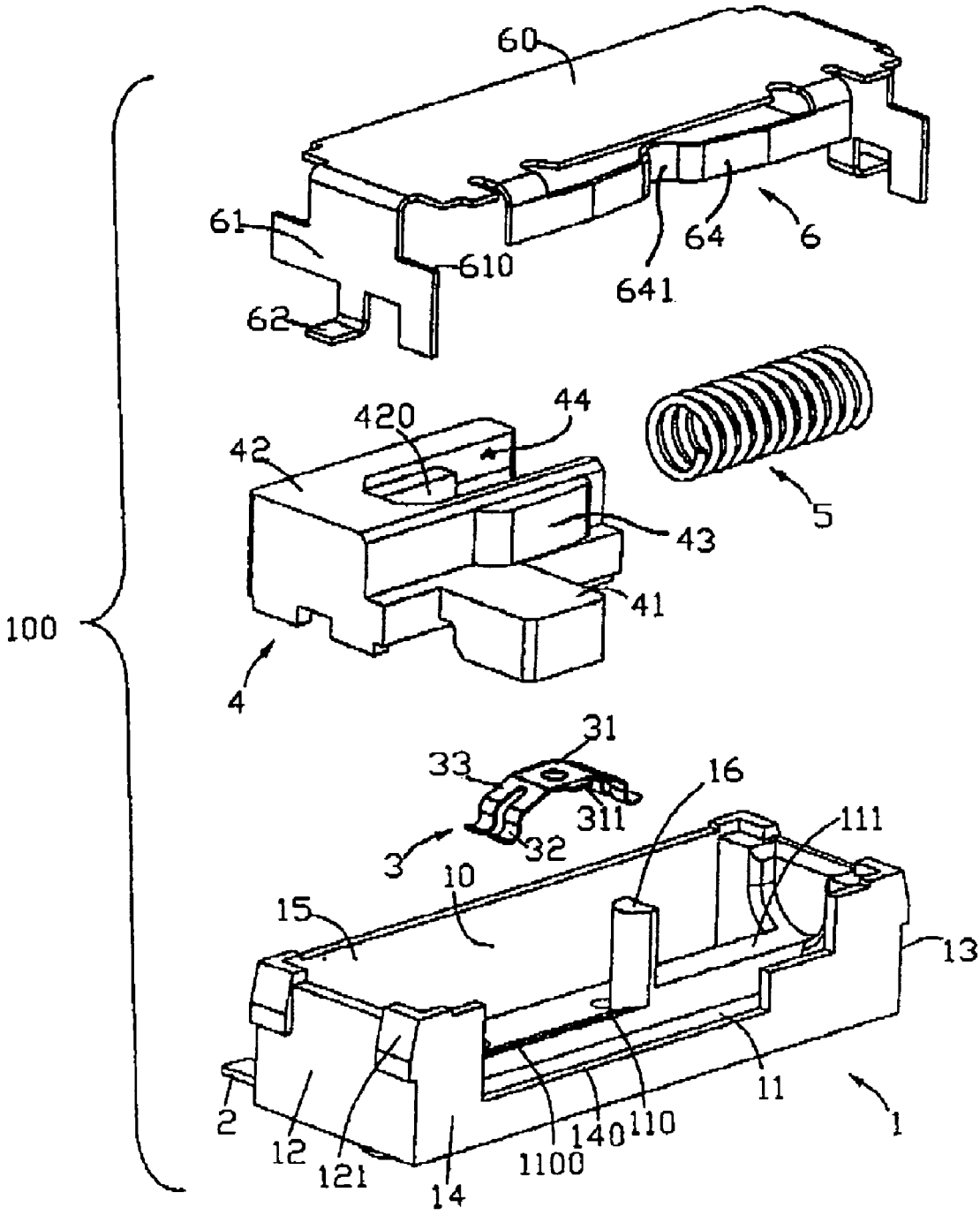
FIG. 1 is an exploded, perspective view of a switch in accordance with the preferred embodiment of the present invention.
Figure 2:
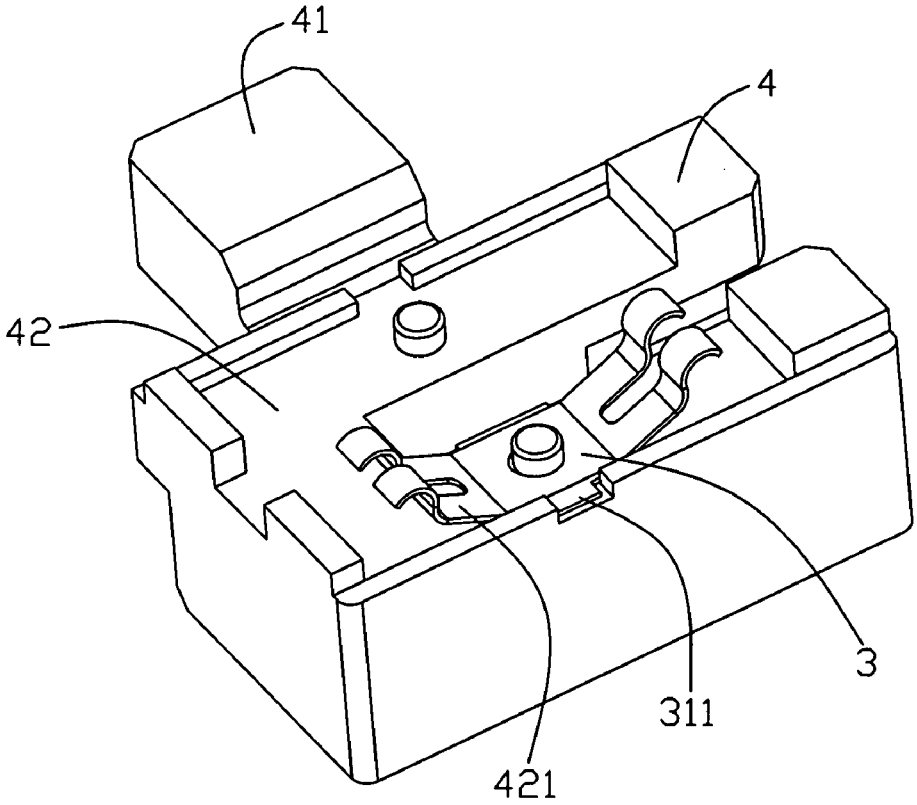
FIG. 2 is an assembled view of a moveable contact and a slide member of the switch.
Figure 3:
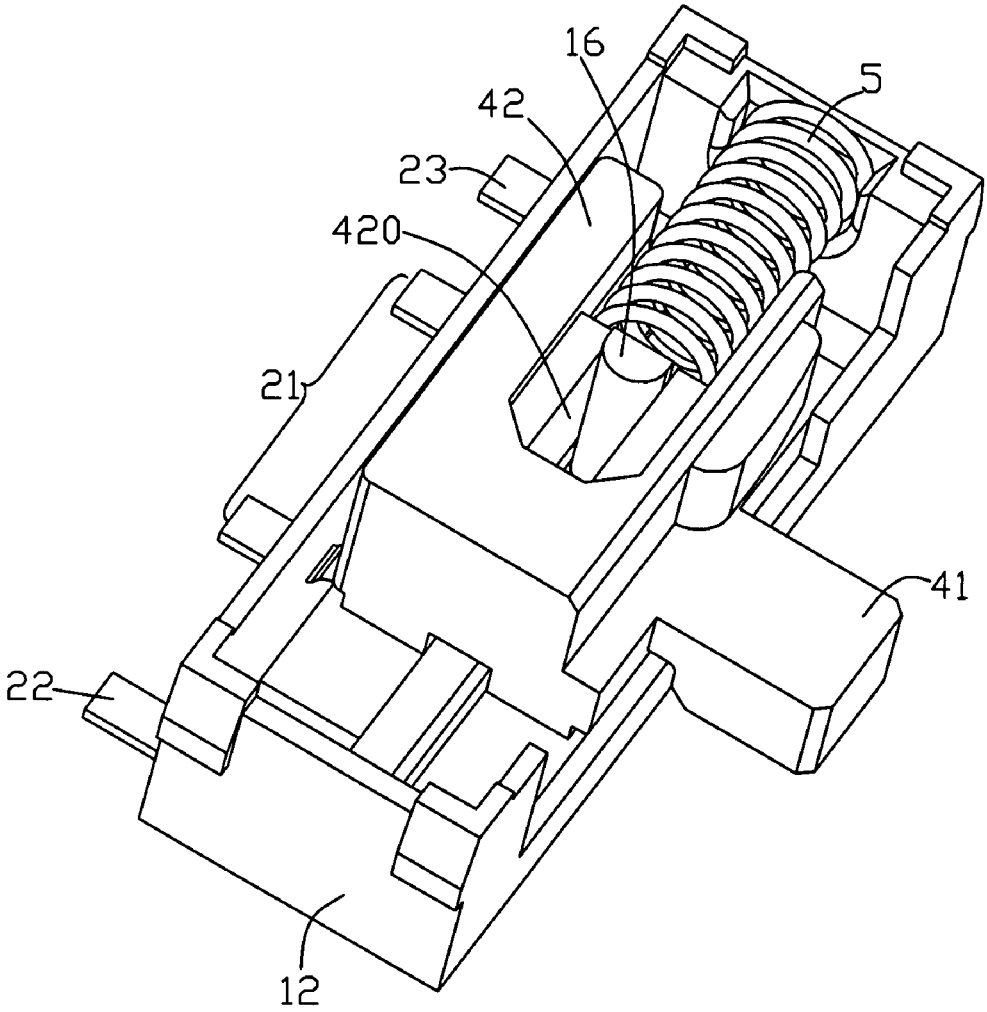
FIG. 3 is an isometric view of the assembled switch of FIG. 1 before assembling the cover.
Figure 4:
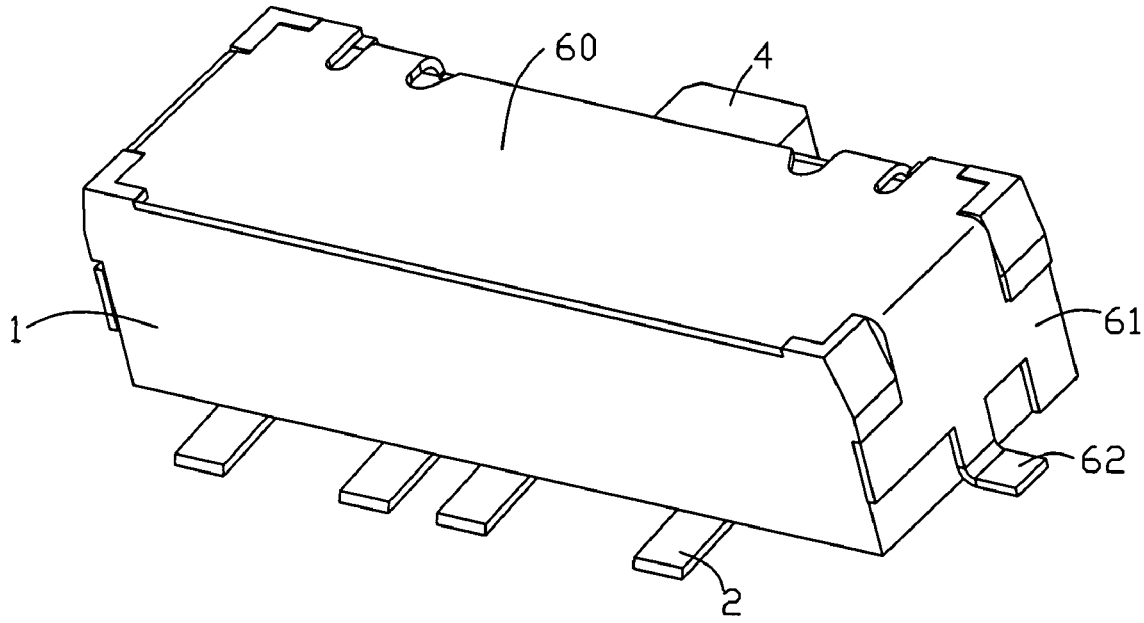
FIG. 4 is an isometric view of the assembled switch of FIG. 1.

Referring to FIGS. 1-4, a switch 100 in accordance with the preferred embodiment of the present invention comprises a dielectric housing 1, a plurality of stationary contacts 2 disposed in the housing 1, a flexible moveable contact 3, a slide element 4 movably mounted in the housing 1, a coil spring 5 disposed in the housing 1, and a cover 6 attached to the housing 1.

The housing 1 has a longitudinal configuration. The housing 1 defines a bottom wall 11 and four side walls such as the first wall 12, the second wall 13, the third wall 14, and the fourth wall 15. The bottom wall 11 and the four side walls forms a space 10 to receive the moveable contact 3, the slide member 4, and the spring 5. The third side wall 14 defines a receiving opening 140 to receive the slide member 4. Each of the first side wall 12 and the second side wall 13 of the hosing 1 defines a pair of protrusions 121 to retain the cover 6. The middle portion of the bottom wall 11 of the housing 1 defines a slide-way 110 to guide the slide member 4. The slide-way 110 defines an inclined surface 1100 facing the stationary contacts 2 to enlarge the space for the moveable contact 3 and thus prevent distortion of the moveable contact 3 during assembling. A locating post 16 defined at the longitudinal end of the slide-way 110 has a semi-circular configuration and extends from the bottom wall 11 of the housing 1. The locating post 16, the bottom wall 11 and the second side wall 13 form a receiving slot 111 to receive the spring 5.

The stationary contacts 2 are embedded in the bottom wall 11 of the housing 1 and comprise a first contact 21 in the middle, a second contact 22 and a third contact 23 located besides the first contact 21. Each of the stationary contacts 2 defines a contacting portion for electrically contacting the moveable contact 3 and a tail which connects with the printed circuit board.

The moveable contact 3 is slightly bent and comprises a central fixing portion 31, two contacting portions 32 connecting with the stationary contacts 2 and two linking portions 33 connecting the fixing portion 31 and the contacting portions 32. The fixing portion 31 defines an extending portion 311 which extends towards the side surface of the slide member 4 to fix the moveable contact 3.

The slide member 4 comprises an operating portion 41 and a containing portion 42. The containing portion 42 defines a slide groove 420 along which the slide member 4 can slide relative to the locating post 16. The width of the slide groove 420 is smaller than the diameter of the spring 5. The slide member 4 further comprises a recess 421 to receive the moveable contact 3. The slide member 4 further includes a receiving space 44, in communication with the slide groove 420, to receive the spring 5, and a protrusion 43 on a side facing the receiving opening 140.

The cover 6 comprises a longitudinal main body 60 and a pair of retaining portion 61 extending from two ends of the main body 60. The retaining portion 61 has an inverted "T" shaped configuration. A soldering tail 62 extends from lower end of the retaining portion 61. The retaining portion 61 defines two blacking walls 610 to hold a respective pair of protrusions 121 of the first side wall 12 and the second side wall 13 of the housing 1. The cover further includes a spring tang 64, around the receiving opening 140, with a bulge 641 thereon corresponding to the protrusion 43.

In assembly, the moveable contact 3 is fixed to the recess 421 of the containing portion 42, the spring 5 is accommodated in the receiving slot 111 of the housing 1, and the cover 6 is subsequently mounted onto the housing 1. The two ends of the spring 5 abut the locating post 16 and the second side wall 13 of the housing 1, respectively. When the slide member 4 and associated end of the spring 5 slide towards the second side wall 13, the locating post 16 is situated in the slide groove 420 of the slide member 4 to control the path of the slide member 4.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. A switch comprising:

a dielectric housing comprising a bottom wall, a plurality of side walls, and a locating post extending from said bottom wall;

a spring confined between one of the side walls and the locating post;

a plurality of stationary contacts embedded in the housing;

a slide member moveably mounted in the housing and defining a slide groove along which the slide member slides relative to the locating post, the width of the slide groove being smaller than the diameter of the spring;

a moveable contact fixing to said slide member;

a cover attached to the housing and the slide member; wherein the bottom wall, the locating post, and one of the side walls form a receiving slot to receive the spring.

2. A switch comprising:

a dielectric housing defining a cavity with an upwardly extending post therein, a compression spring having one end biasing against the post;

a plurality of stationary contacts embedded in the housing with contacting portions exposing into the cavity;

a slide member moveably mounted in the cavity and defining a slide groove constantly receiving said post so that the slide member slides relative to the locating post along said slide groove; and a moveable contact fixing to said slide member for selective engagement with the corresponding stationary contacts; wherein the slide member pushes the spring backward to disengage the spring from the locating post during operation of the switch.

3. The switch as claimed in claim 2, wherein said post is snugly received in the slide groove.

4. The switch as claimed in claim 2, wherein said slide member defines a receiving space in communication with the slide groove to receive a portion of the spring having said abutment end thereof.

5. A switch comprising:

a dielectric housing defining a cavity with an upwardly extending post therein;

a compression coil spring defining an axis direction thereof and having one abutment end biasing against the post;

a plurality of stationary contacts embedded in the housing with contacting portions exposing into the cavity;

a slide member moveably mounted in the cavity and defining a receiving space around said post to constantly receive a portion of said coil spring including said abutment end, under a condition said slide member is moveable along said axial direction; and a moveable contact fixing to said slide member for selective engagement with the corresponding stationary contacts; wherein the slide member pushes the spring backward to disengage the spring from the location post during operation of the switch.

* * * * *